United States Patent [19]

Lopez Lopez

[11] Patent Number: 4,527,345

[45] Date of Patent: Jul. 9, 1985

[54] SOLES FOR SPORT SHOES

[75] Inventor: Julio Lopez Lopez, Castellon de la Plana, Spain

[73] Assignee: Griplite, S.L., Spain

[21] Appl. No.: 502,005

[22] Filed: Jun. 7, 1983

[30] Foreign Application Priority Data

Jun. 9, 1982 [ES] Spain ..... 265758
Jun. 18, 1982 [ES] Spain ..... 265954

[51] Int. Cl.[3] ..... A43B 5/00; A43B 13/04; A43B 5/06

[52] U.S. Cl. ..... 36/127; 36/31; 36/32 R; 36/59 C; D2/320

[58] Field of Search ..... 36/59 C, 32 R, 31, 127; D2/320

[56] References Cited

U.S. PATENT DOCUMENTS 2,038,972 4/1936 Watanabe ..... 36/32 R
3,327,334 6/1967 Wilmanns et al. ..... 36/32 R
4,161,828 7/1979 Benseler et al. ..... 36/59 C
4,309,376 1/1982 Ueno et al. ..... 36/32 R
4,398,357 8/1983 Batra ..... 36/31

FOREIGN PATENT DOCUMENTS 2751146 5/1979 Fed. Rep. of Germany ..... 36/31
2806481 8/1979 Fed. Rep. of Germany ..... 36/31

*Primary Examiner*—Werner H. Schroeder
*Assistant Examiner*—Steven N. Meyers
*Attorney, Agent, or Firm*—Eugene E. Renz, Jr.

[57] ABSTRACT

A pair of soles for sport shoes having a dividing line between the heel and toe dividing the soles into inner and outer portions. The inner portion of the first sole along with the outer portion of the second sole having shallow recesses in a substantially smooth surface, while the outer portion of the first shoe and the inner portion of the second shoe having a plurality of stud-like projections.

7 Claims, 14 Drawing Figures

Figure 1:
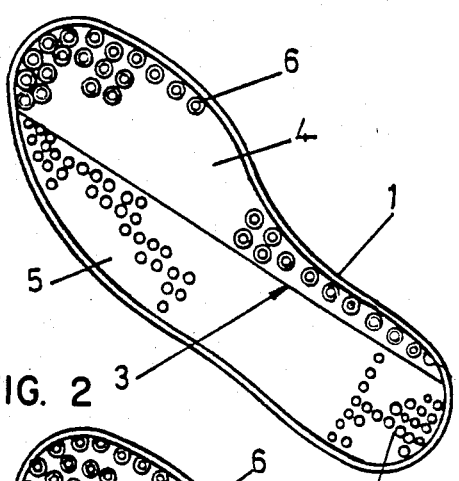
Figure 1A:
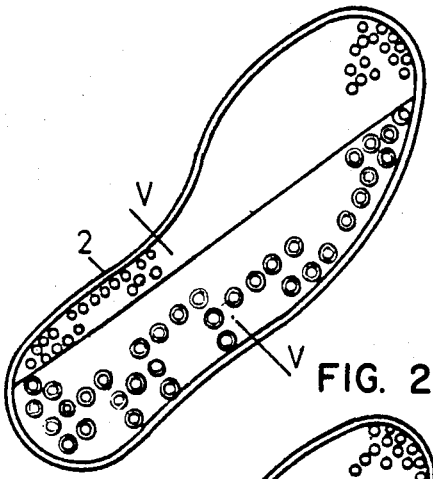

FIG. 5
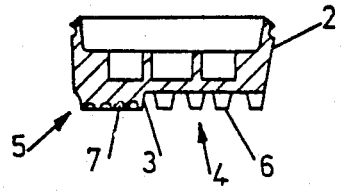
FIG. 6
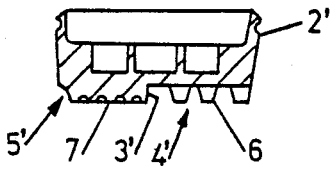
FIG. 7
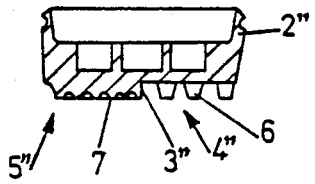
FIG. 8
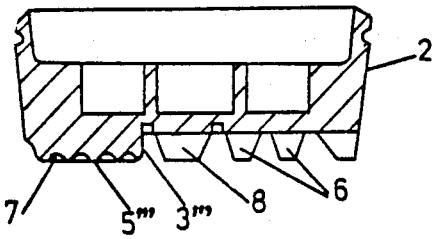
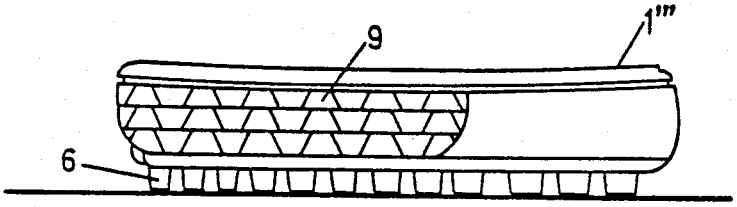
FIG. 9
FIG. 10
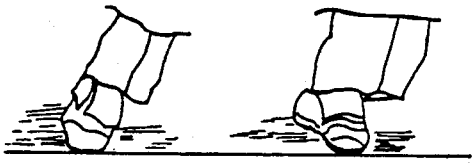

SOLES FOR SPORT SHOES

The present invention relates to a sports shoe and more particularly to a set of soles for a sports shoe.

The general practice of manufacturers of sports shoes has been to produce the sole of the shoe of one foot as a symmetrical mate to that of the other foot, both as regards the shape and as regards the design or arrangement of protuberances and rough surfaces which are intended to facilitate adhesion or perfect gripping of the foot on the ground. This practice, which may be normal in sports which we could refer to as symmetrical, that is to say in which the same forces are involved on both feet, is illogical for sports which could be referred to as asymmetrical, that is to say those sports in which one foot has to withstand a different force from that of the other foot, as happens in golf, tennis, etc.

It is evident that so far the sports shoe has not been the subject of deep study, bearing in mind the stresses which may apply to each of the feet of the athlete or player for these stresses to be perfectly offset to ensure that the shoe has a better grip on the ground and that the user has a greater feeling of security while performing the sporting activity, so that performance is enhanced as far as possible, no other circumstances arising which might produce instability, insecurity, a poor grip of the foot, etc., etc., which undoubtedly would affect the quality of the physical effort performed by the user.

A thorough study of the shoes which exist to-date and a study of the positions of the feet in respect of the ground have given cause to consider that the optimum form of these shoes, in some of these sporting activities such as, for example, golf, requires in terms of force to be developed, that the weight of the player when pressing down on both balls of the feet, should have a line of maximum pressure and grip against the ground to permit the user to enjoy a better sense of security whereas the shoe does not entail any risk due to the form of the sole, lacking spikes, so that the player can move about not only on a playing surface of any kind but also on any other type of surface, including parquet.

The main feature of this shoe resides in that the sole, on its face which comes in contact with the ground, is moulded to offer a clear division in two perfectly different parts separated from each other by a line consisting of the actual line separating the two surfaces, these two surfaces being characterised in that one of these surfaces is shaped by a plurality of small nipples, all identical, which are suitably shaped, regularly or otherwise, the other part of the sole consisting of a smooth surface on which there are a plurality of tiny cavities, all identical, with regard to which it should be pointed out that within one pair of soles, one of the two designs is on the right-hand side of both while the other type of design is on the left-hand side, so that both soles are absolutely identical in their arrangement.

The separating line dividing the sole into the two parts we have mentioned may be a straight line or a sinusoidal line and may produced always from the part of the toe cap which drops away outwardly, to the part of the heel which drops inwardly, whether the line is straight or sinusoidal or whether the line separating the two areas of different design starts as a straight or sinusoidal line from the midway point of the toe cap to the midway point of the heel.

Referring now specifically to the game of golf, it must be borne in mind that this game is played on large areas of land covered with grass or turf, the maintenance of which demands care and therefore this type of shoe has been designed in order firstly to provide greater stability for the player on the grass when he is twisting his body to strike the ball and secondly so that no damage to the sward is caused, because such damage is reflected in unexpected movement of the ball which may result in the player missing a hole and consequently suffering disappointment.

In view of the conditions and nature of the ground on which golf tournaments are played, and the need for the player to have a secure position on the ground, it has for a long time been usual for the shoes worn by the players to have on their underside spikes which can be fixed or replaceable, suitably situated, four on the heel and six or seven on the front part, naturally depending upon the size of the shoe. The purpose of these spikes is purely to ensure that, at the moment of striking the ball, the player is firmly supported on the ground because it must be recognised, as previously stated, that the game is played on grass which normally is damp, and that there is a certain risk of the player slipping at that precise moment, In addition, the practice of this game obliges the player to walk over the entire course, which is also of grass.

In view of these requirements, all the innovations which have been forthcoming in the manufacture of this type of shoe have tended to produce shoes which are lighter in weight, employing new materials while maintaining the same arrangement of spikes. The only substantial change which is known in these shoes is that in England, a shoe has appeared which, instead of spikes, has a sole made from rubber and on which large studs are moulded to replace the spikes and although this does offer the natural advantage of being more comfortable and lighter in weight, and that the shoe does not damage the ground when the wearer is walking on ordinary surfaces, the said shoe has one major drawback in that many golf courses prohibit its use because, when the player reaches the green, that is to say the space in which the hole is situated, these large studs leave substantial hollows in the very fine sward around the hole, causing the ball to follow very strange lines.

Therefore, the problem which had to be resolved was nothing more than one of finding a sole for a shoe for the sport of golf, a sole which allows the player to "grip" the ground at the moment of hitting the ball, so that he feels secure, and also which harmonises with the force and intentions of the player, and which does not mark the green when the player is on it.

After a detailed analysis of the movements of the player, the flight of the club, particularly when the player is driving, it has been observed that all the effort, that is to say the maximum grip of the player, is exerted on the right foot in one part and on the left foot in another, so that we might consider that due to the flexibility of the shoe, naturally of the sole, the position of the foot rocks on a line of optimum effort which can be traced in a longitudinal direction, that is to say from the toe cap to the heel, the lines meeting to form an angle which converges from the front to the back, that is to say in the correct position of the feet, these lines are more greatly separated at the toe cap end than at the heel end, and not only because when in the natural, relaxed position of the feet the heels are closer to each other, but because these lines of maximum grip, and on which the weight of the player bears during his movements which swing from one side to the other without the feet becoming detached from the ground means that these lines exhibit a certain obliquity also on the shoe, that is to say they are not lines which we could consider as extending from the centre of the toe cap to the centre of the heel, although as previously stated they could go from centre to centre. Instead, it may be considered that they start from a point situated closer to the outside of the toe caps and end at points which are more on the inside of the heels, these lines being perfectly marked by a line of coarser studs, the alignment of which is perfectly straight and follows the line oblique to that previously mentioned. In turn, this line of maximum stress divides the shoe naturally into two quite different zones which are distinct in nature, so that the effect of the sole on the green is virtually nil since it leaves no mark on the green. At the same time there is no adverse effect on the stability and grip of the shoe on the ground. One of these zones has a plurality of studs which are substantially smaller than those of the line of maximum stress, and these studs remain on both soles in the zone which falls away to the left side, while the other zone of the sole, naturally falling away to the right side of both soles, consists of a surface having different areas, with the studs of maximum stress and the studs of the other zone, but it does have a plurality of small very diminutive recesses which make up the rest of the sole, and it is possible to locate the spaces or recesses to receive trade marks or size numberings which are logical in any manufactured footwear.

We must stress that the toe cap of the shoe worn on the right foot of the user and extending for a considerable distance along the inside carries a plurality of moulded projections, like fish scales, which during movements in which the body is inclined, while the game is being played, seek to increase the grip of the shoe on the ground, for instance during the final stage of the swing.

To facilitate understanding of the present invention, there follows a detailed description in which reference is made to the appended drawings, in which.

Figure 4:
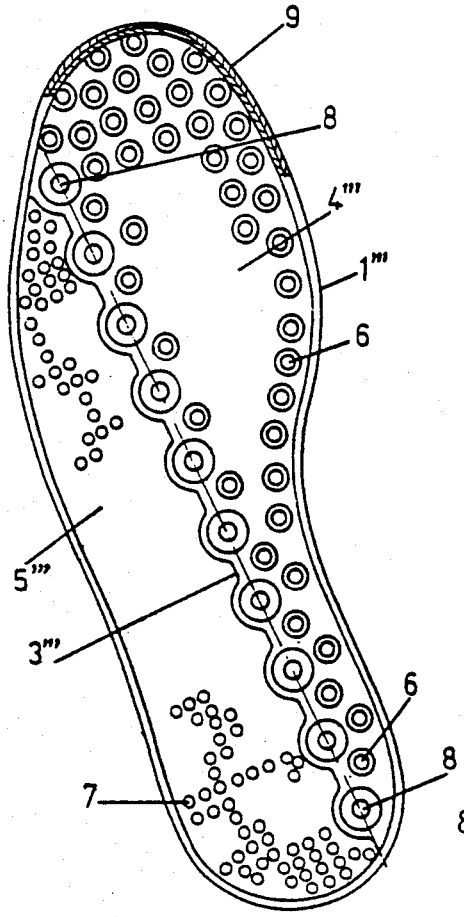

FIGS. 1 to 4*a* show sets of sports shoe soles according to the present invention, seen in plan view from below;

FIGS. 5 to 8 show the respective cross-sections of one of the soles illustrated in FIGS. 1 to 4;

FIG. 9 is a side elevation of the toe part of the sole corresponding to the right foot in FIG. 4, and FIG. 10 shows the position of the feet of a golfer when he is starting the accelerated down swing in which the club is going to strike the ball. This drawing is included to show that the player's feet are both inclined over towards one and the same side, since the body is arched in this same direction in order to ensure balance or a central position at the moment of initiating impact, and naturally the body will swing to the other side as a consequence of the force of inertia generated.

With reference to the drawings, it can be seen that on the four sets of soles illustrated, reference numerals 1, 1', 1'' and 1''' relate to the right foot while 2, 2', 2'' and 2''' relate to the left foot.

Figure 2:
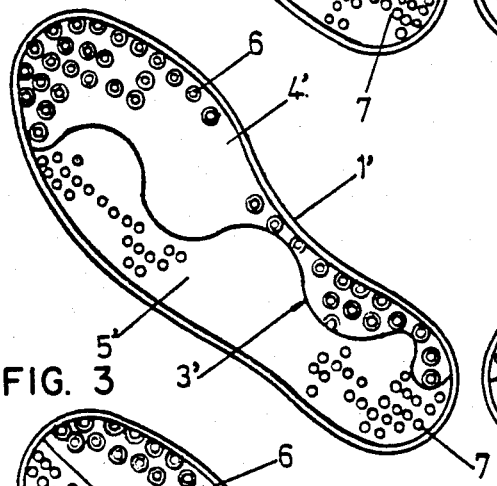
Figure 2A:
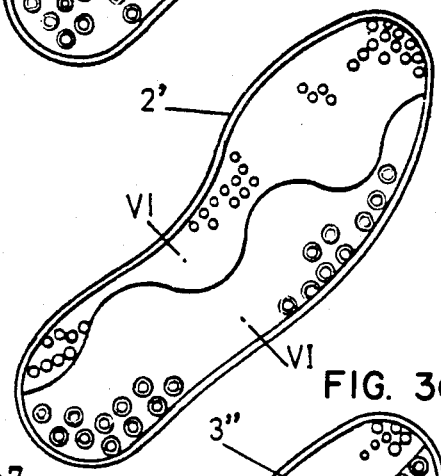
Figure 3:
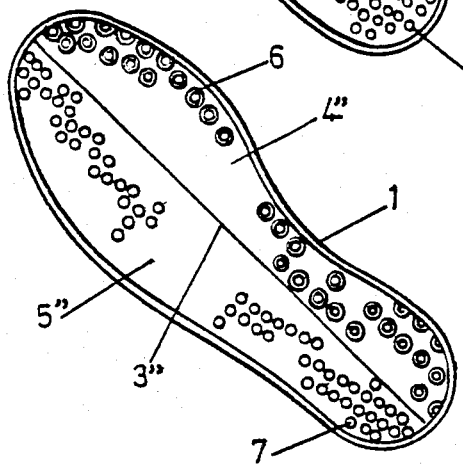
Figure 3A:
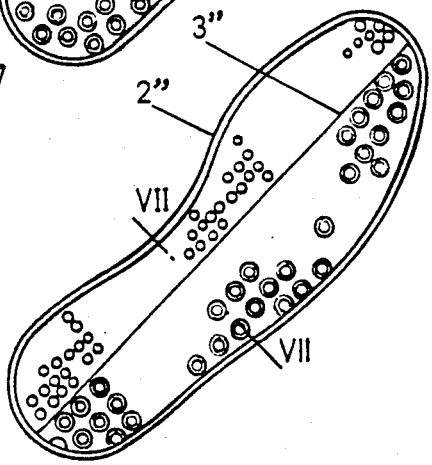

Reference numerals 3, 3', 3'' and 3''' show a line dividing each sole into two zones respectively 4, 4', 4'' and 4''' and 5, 5', 5'' and 5'''. The lines 3 extend from the toe cap to the heel of the sole and may be straight as shown in FIGS. 1, 1*a*, 3, 3*a*, 4 and 4*a* or curved as shown in FIGS. 2 and 2*a* may extend from the centre of the toe cap to the centre of the heel (3'' in FIGS. 3 and 3*a*) or from the outer part of the toe cap to the inner part of the heel (3, 3' and 3''' in FIGS. 1, 1*a*, 2, 2*a*, and 4, 4*a* respectively).

The zones 4, 4', 4'' and 4''' are provided with studs 6, the free ends of which lie in the same plane as the surfaces of the zones 5, 5', 5'' and 5''' which are provided with small recesses 7.

As can be seen, the soles of each of the sets has areas of studs on one and the same side and not symmetrically arranged as was previously normal practice.

Let us now refer solely to FIGS. 4, 4*a*, 8 and 9 which show a set of soles designed especially for golf.

Figure 4A:
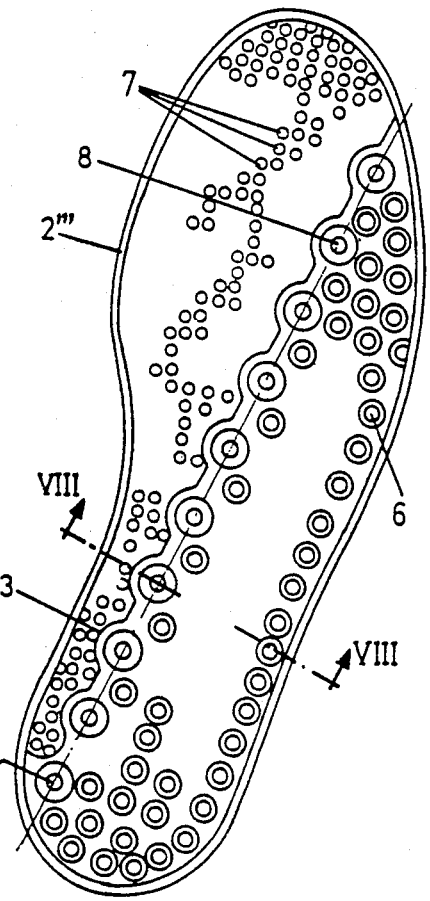

FIGS. 4 and 4*a* show the set of soles of a shoe in accordance with the foregoing description. In it, the sole which is on the left-hand side of the drawing is that which corresponds to the shoe worn on the right foot and logically that shown on the right-hand side of the drawing is the one corresponding to the left foot of the user; FIG. 8 shows the cross-section through a sole taken on the line VIII—VIII and relates in fact to the left foot.

In the drawing, reference numerals 1''' and 2''' identify the soles in question, which correspond respectively to the right and left-hand feet of the user. In both we can see the inclined lines of maximum stress which are determined by the straight alignment of the larger studs 8, and which, in their angle of inclination, tend to converge towards the area of the heels, and which cleanly divide the sole into two parts: one which is occupied by the smaller studs 6 and the other which is occupied by the smooth surface with the very tiny recesses 7. Reference numeral 9 denotes the area of the toe of the shoe which is worn on the right foot, which has projections shaped like fish scales, which contribute to a better grip on the ground while the player's body is swinging. It is sufficient to examine FIG. 10 to see how the right foot of the player is more sharply angled in relation to the ground at the moment of maximum effort.

The structure which is the object of the invention having been adequately described, it only remains for us to state that the circumstances regarding materials, sizes and shapes may vary so long as such likely variations do not affect the essential nature of the invention.

I claim:

1. A set of soles for a left and right pair of sport shoes comprising means defining a dividing line extending from the toe to the heel dividing each sole into inner and outer sole portions, the inner sole portion of one of said soles being a substantially smooth surface having a plurality of shallow recesses therin and the outer sole portion of said one sole having a plurality of stud-like projections, the inner sole portion of the other of said soles having a pluality of stud-like projections and the outer sole portion of said other sole being a substantially smooth surface hajving a plurality of shallow recesses, said recesses being of substantially smaller depth than said stud-like projections.

2. A set of soles as claimed in claim 1 wherein said dividing line extends from the center of the toe to the center of the heel.

3. A set of soles as claimed in claim 1 wherein the dividing line extends from the outer part of the sole to the inner part of the heel.

4. A set of soles as claimed in claim 1 wherein said dividing line is straight.

5. A set of soles as claimed in claim 1 wherein said dividing line is serpentine.

6. A set of soles as claimed in claim 1 wherein the stud-like projections adjacent the dividing line having a larger surface area than those remote from the dividing line.

7. A set of soles as claimed in claim 1 including scale-like projections on the toe portion of at least one of said soles.

* * * * *